US006533710B2

(12) United States Patent
Lin et al.

(10) Patent No.: US 6,533,710 B2
(45) Date of Patent: Mar. 18, 2003

(54) HIP EXERCISER

(76) Inventors: David Lin, 4 Fl., No. 76, Ta-Hsin St., Yungho City, Taipei Hsien (TW); Chih-Liang Chen, No. 10, Lane 1431, Kuanghsing Rd., Pateh City, Taoyuan Hsien (TW)

( * ) Notice: Subject to any disclaimer, the term of this patent is extended or adjusted under 35 U.S.C. 154(b) by 6 days.

(21) Appl. No.: 09/916,547

(22) Filed: Jul. 27, 2001

(65) Prior Publication Data

US 2003/0022768 A1 Jan. 30, 2003

(51) Int. Cl.[7] ..... A63B 21/02
(52) U.S. Cl. ..... 482/123; 482/121; 482/130
(58) Field of Search ..... 482/121, 72, 123, 482/130, 133, 137, 138; D21/676

(56) References Cited

U.S. PATENT DOCUMENTS 5,215,511 A * 6/1993 Cheng ..... 482/121
5,580,340 A * 12/1996 Yu ..... 482/72
5,599,261 A * 2/1997 Easley et al. ..... 482/130
5,722,917 A * 3/1998 Olschansky et al. ..... 482/130
5,899,836 A * 5/1999 Chen ..... 482/130
6,152,866 A * 11/2000 Kuo ..... 482/130

* cited by examiner

*Primary Examiner*—Nicholas D. Lucchesi
*Assistant Examiner*—Tam Nguyen
(74) *Attorney, Agent, or Firm*—Thomas, Kayden, Horstemeyer & Risley LLP

(57) ABSTRACT

A hip exerciser includes a main stand, a front bracket and a rear bracket both pivotally connected to the main stand, at least one resilient member mounted between the front bracket and the rear bracket, a supporting bracket securely mounted on the main stand, a seat pivotally connected to the front bracket, and a backrest pivotally connected to the rear bracket. The hip exerciser further includes an extendable stand moveably extending from the main stand and controlled by a knob. Two shaft are pivotally connected with the extendable stand and two pedals are pivotally connected to free ends of the shaft. When a user sits on the seat and leans on the backrest to pivot the backrest, the front bracket and the rear bracket are also pivoted thus extending the resilient member to provide a resistance force, whereby hips of the user are exercised.

8 Claims, 9 Drawing Sheets

HIP EXERCISER

BACKGROUND OF THE INVENTION

1. Field of the Invention

The present invention relates to an exerciser, and more particularly to a hip exerciser such that a person's hips can be trained by leaning backward and pivoting a backrest of the hip exerciser.

2. Description of Related Art

Body fitness is a matter that more and more people are concerned about. Accordingly all kinds exercisers used for body fitness have been invented and manufactured. Some exercisers are designed to work out only particular portions of a human body. For example, a hip exerciser is designed mostly to provide a workout for hip muscles.

With reference to FIG. 9, a conventional hip exerciser has a bracket (90) rested on a floor. A backrest (92) and a headrest (94) are respectively mounted on a top side of the bracket (90). A handle (96) is connected to the bracket (90) by a damping device (98). When in operation, a user lies on the backrest (92) and the headrest (94) while placing the handle (96) on his abdomen. Then the user flexes abdominal muscles against the handle (96) and pushes the handle (96) upward. Due to a resistance force provided by the damping device (98), hips of the user are exercised.

However, the operation of the conventional hip exerciser mentioned is dull and so a user quickly loses interest and motivation to use the device. Moreover the position of the user during the operation is not comfortable enough. Therefore it is difficult for the user to continuously use the conventional exerciser for a period of time.

To overcome the shortcomings, the present invention tends to provide a hip exerciser to mitigate or obviate the aforementioned problems.

SUMMARY OF THE INVENTION

An objective of the present invention is to provide a hip exerciser such that hips of a user can be exercised comfortably and safely.

Another objective of the present invention is to provide a hip exerciser suitable for users of different sizes.

Another objective of the present invention is to provide a hip exerciser that can be modified into a leg exerciser.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
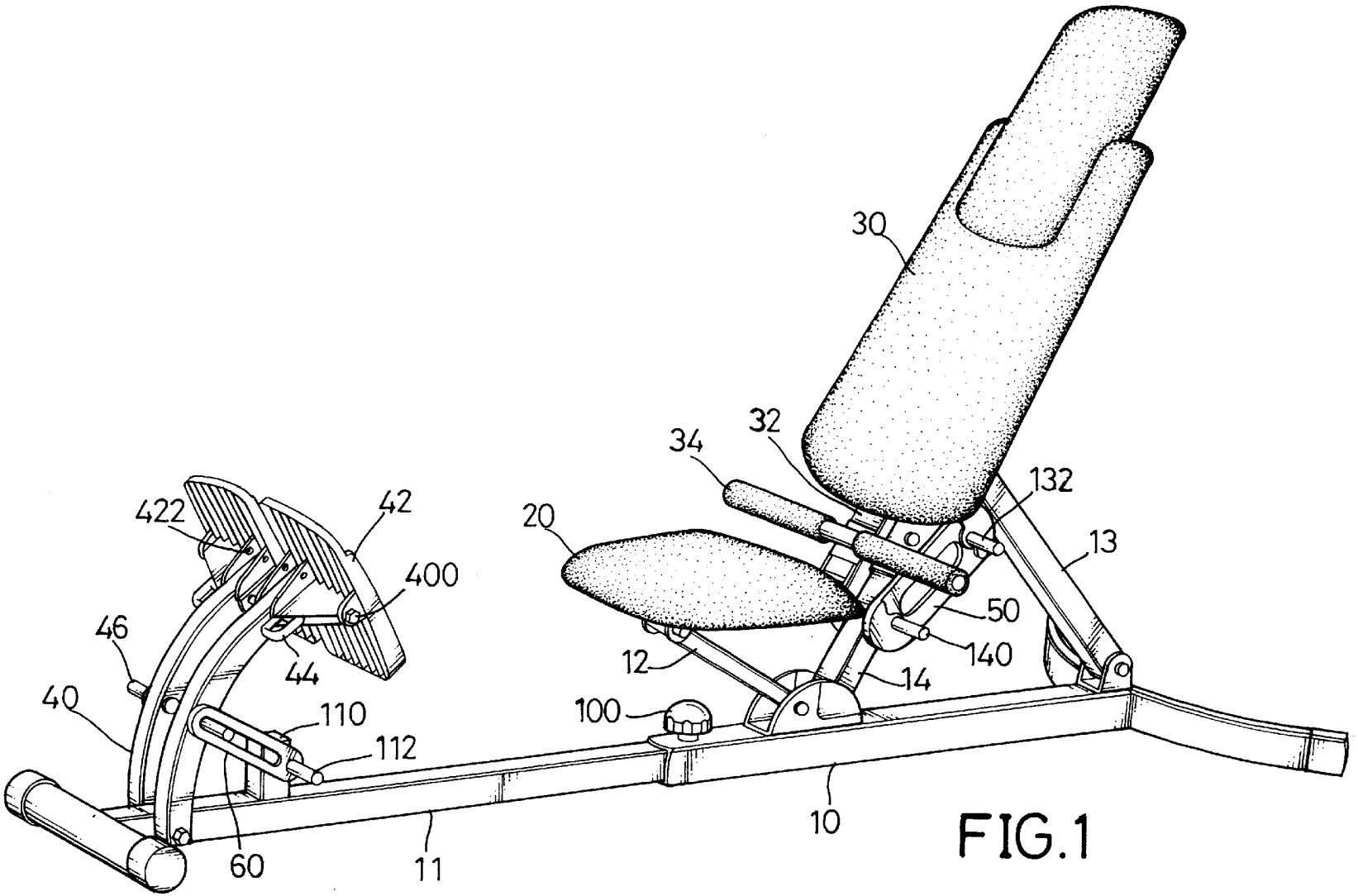
FIG. 1 is a perspective view of the hip exerciser in accordance with the present invention.
Figure 2:
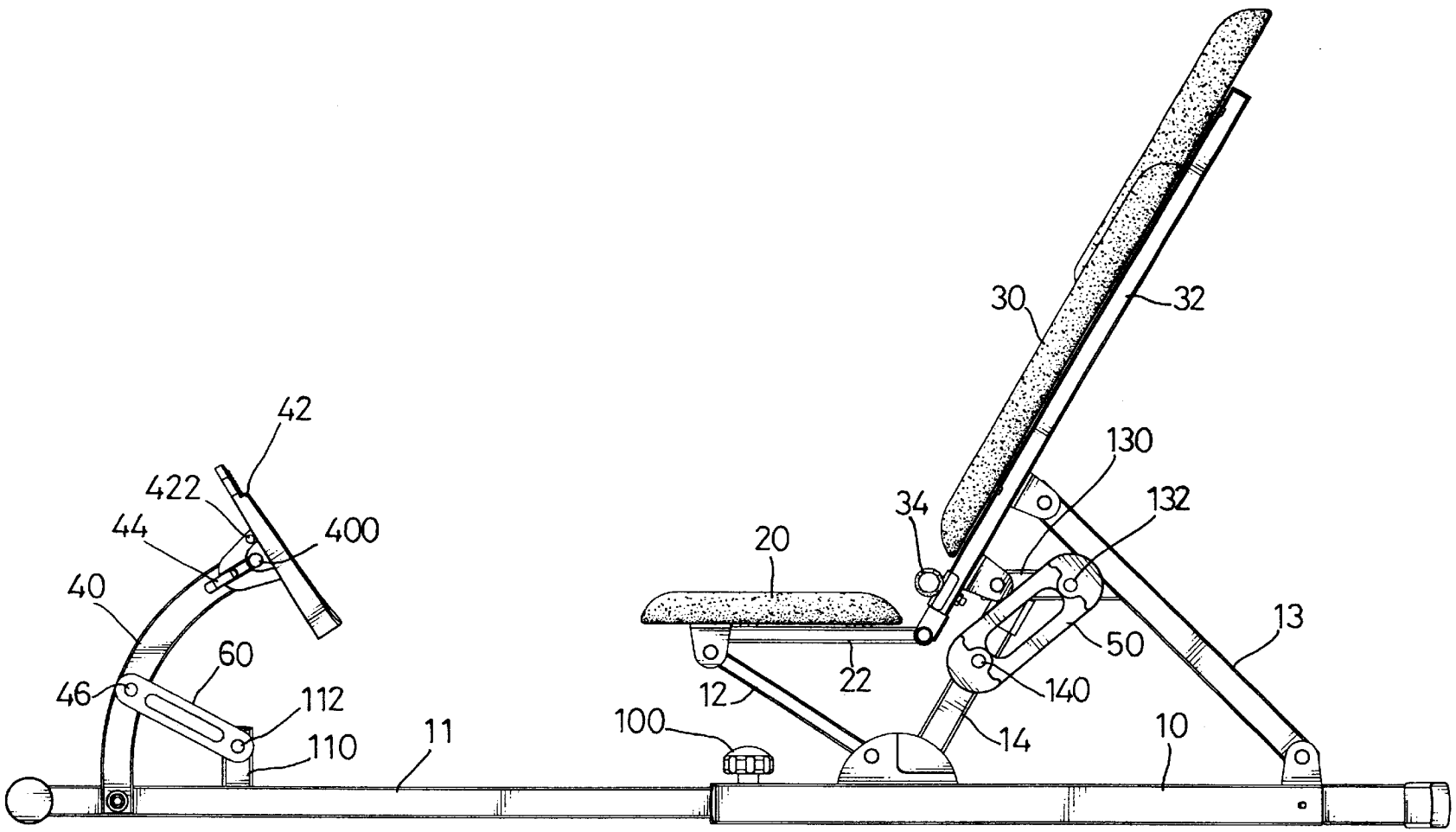
FIG. 2 is a side view of the hip exerciser of FIG. 1.

With reference to FIGS. 1 and 2, a hip exerciser in accordance with the present invention has a main stand (10) resting on the ground. The main stand (10) has a front bracket (12) and a rear bracket (13) each pivotally connected to the main stand (10). The main stand (10) further has a supporting bracket (14) securely mounted on the main stand (10) and between the front bracket (12) and the rear bracket (13), wherein the supporting bracket (14) provides support by way of a top face of the supporting bracket (14) abutting the rear bracket (13). A seat support (22) is pivotally connected to an opposed end of the front bracket (12) with respect to the main stand (10), and similarly, a backrest support (32) is also pivotally connected to an opposed end of the rear bracket (13) with respect to the main stand (10). The rear bracket (13) further has a branch rod (130) extending from the rear bracket (13), and the branch rod (130) is also pivotally connected with the backrest support (32). The seat support (22) and the backrest support (32) are pivotally connected together, while a seat (20) is securely mounted on the seat support (22) and a backrest (30) is securely mounted on the backrest support (32). A handle (34) is securely mounted to the seat support (32) near the joint that pivotally connects the front bracket (12) and the rear bracket (13) together. The handle (34) is arranged for a user to grasp and maintain balance thereby. Two first rods (132) extend from opposed sides of the branch rod (130) of the rear bracket (13) and two second rods (140) extend from opposed sides of the supporting bracket (14) so that two resilient members (50) are respectively mounted between the first rods (132) and the second rods (140).

An extendable stand (11) is partially received in and moveably extends from the front end of the main stand (10). A knob (100) is mounted on the main stand (10) to control the relative position between the main stand (10) and the extendable stand (11). A column (110) is integrally and upwardly formed on the extendable stand (11). Two shafts (40) are pivotally connected to a front portion of the extendable stand (11) and two pedals (42) are respectively connected to free ends of the shafts (40). Two third rods (112) extend from opposed sides of the column (110) while two fourth rods (46) respectively and oppositely extend from outward sides of the shaft (40). Two securing members (60) are each mounted between a set of the third rods (112) and the fourth rods (46), whereby the shafts (40) are secured in the positions shown in FIGS. 1 and 2.

Figure 3:
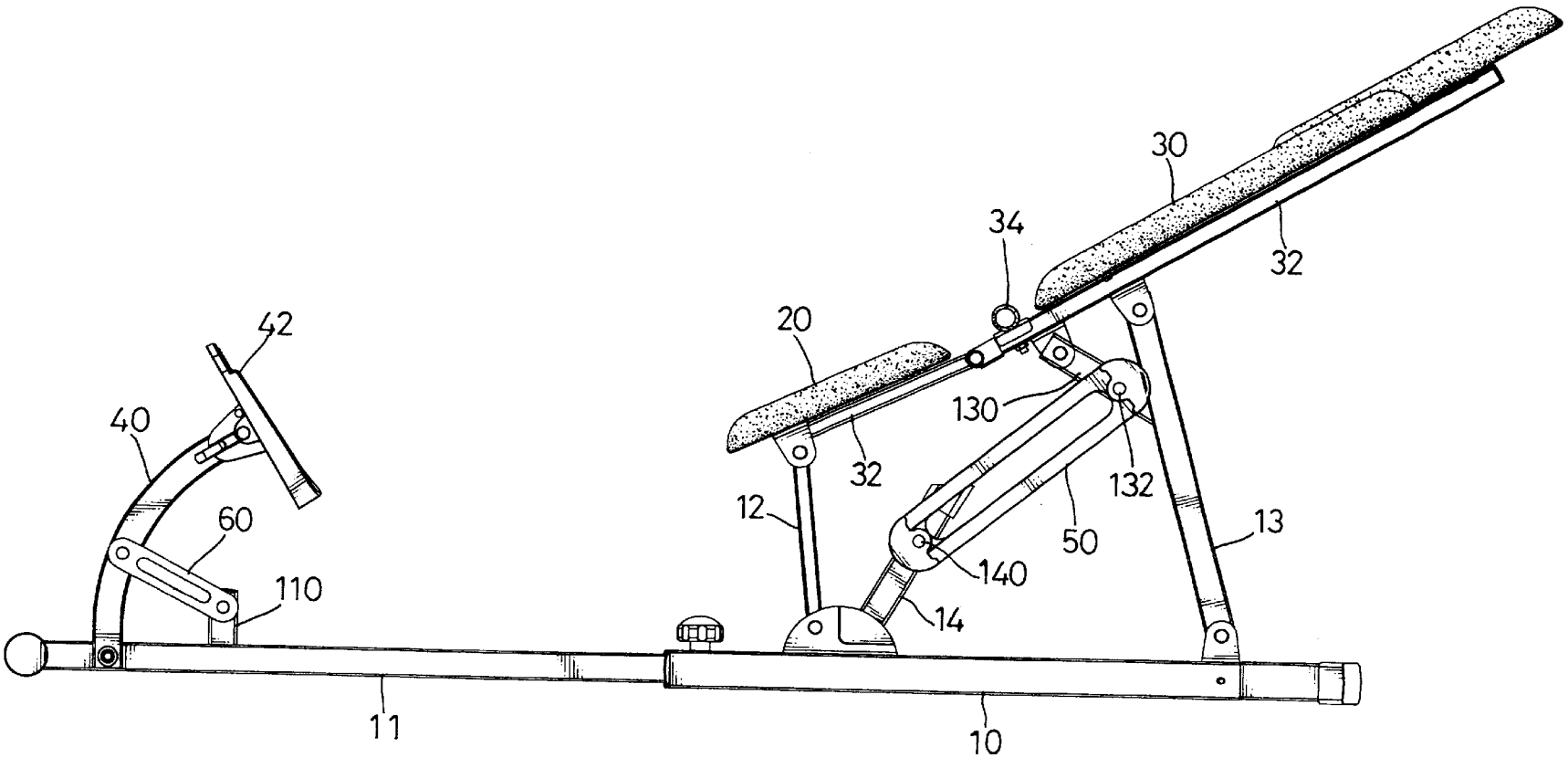
FIG. 3 is an operational, side view of the hip exerciser of FIG. 1.

With reference to FIG. 3, when operating, the user sits on the seat (20) and leans back against the backrest (30) while stepping on the pedals (42). Then the user pushes back to pivot the backrest (30) backward, that is, to pivot the backrest (30) from the position shown in FIG. 2 to the position shown FIG. 3. During the pivotal moment of the backrest (30), the front bracket (12) and the rear bracket (13) are also pivoted, whereby the resilient members (50) are extended to provide a resistance force. When the user reduces the backward pressure, the extended resilient members (50) provide a return force to pivot the backrest (30) from the position shown in FIG. 3 back to the position shown in FIG. 2, wherein the rear bracket (13) abuts the top face of the supporting bracket (14).

After a long term use of the hip exerciser, the resilient member may experience fatigue and then fracture. If this happens, the front bracket (12) will abut the supporting bracket (14) securely mounted on the main stand (10) thus limiting the range that the front bracket (12) is able to pivot. Accordingly, the seat (20) and the backrest (30) are prevented from collapsing to the ground.

Figure 4:
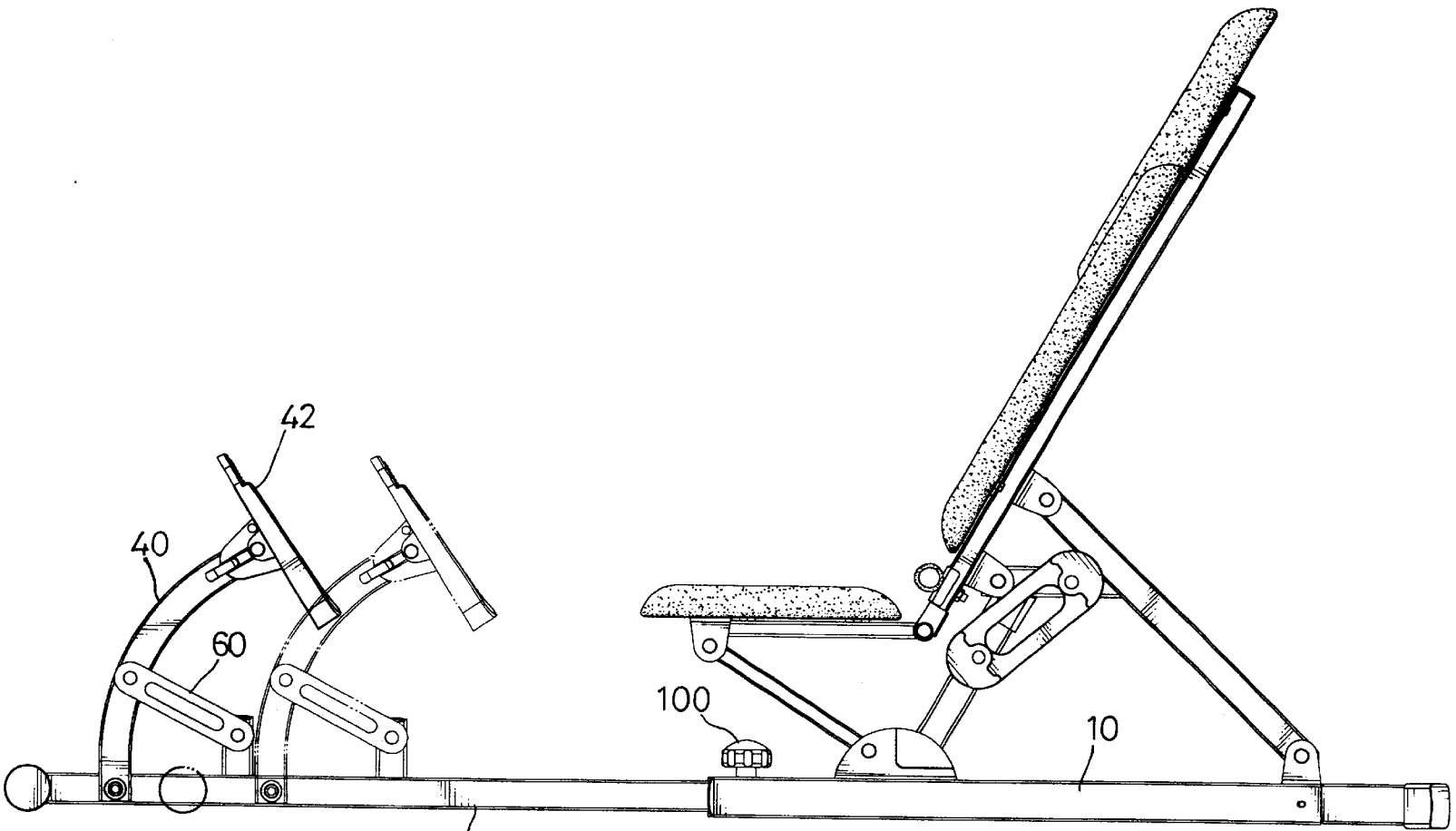
FIG. 4 is schematic, side view of the hip exerciser when adjusting an extendable stand of the hip exerciser.

With reference to FIG. 4, the extendable stand (11) is moveably extendable with respect to the main stand (10) in order to suit users of different sizes. When adjusting the hip exerciser, the knob (100) is released. The extendable stand (11) can extend out of or retract into the main stand (10), and the distance between the pedals (42) and the seat (20) is changed accordingly. When adjusted to a suitable distance, the knob (100) is tightly fastened and the relative position of the main stand (10) and the extendable stand (11) is then fixed.

Figure 5:
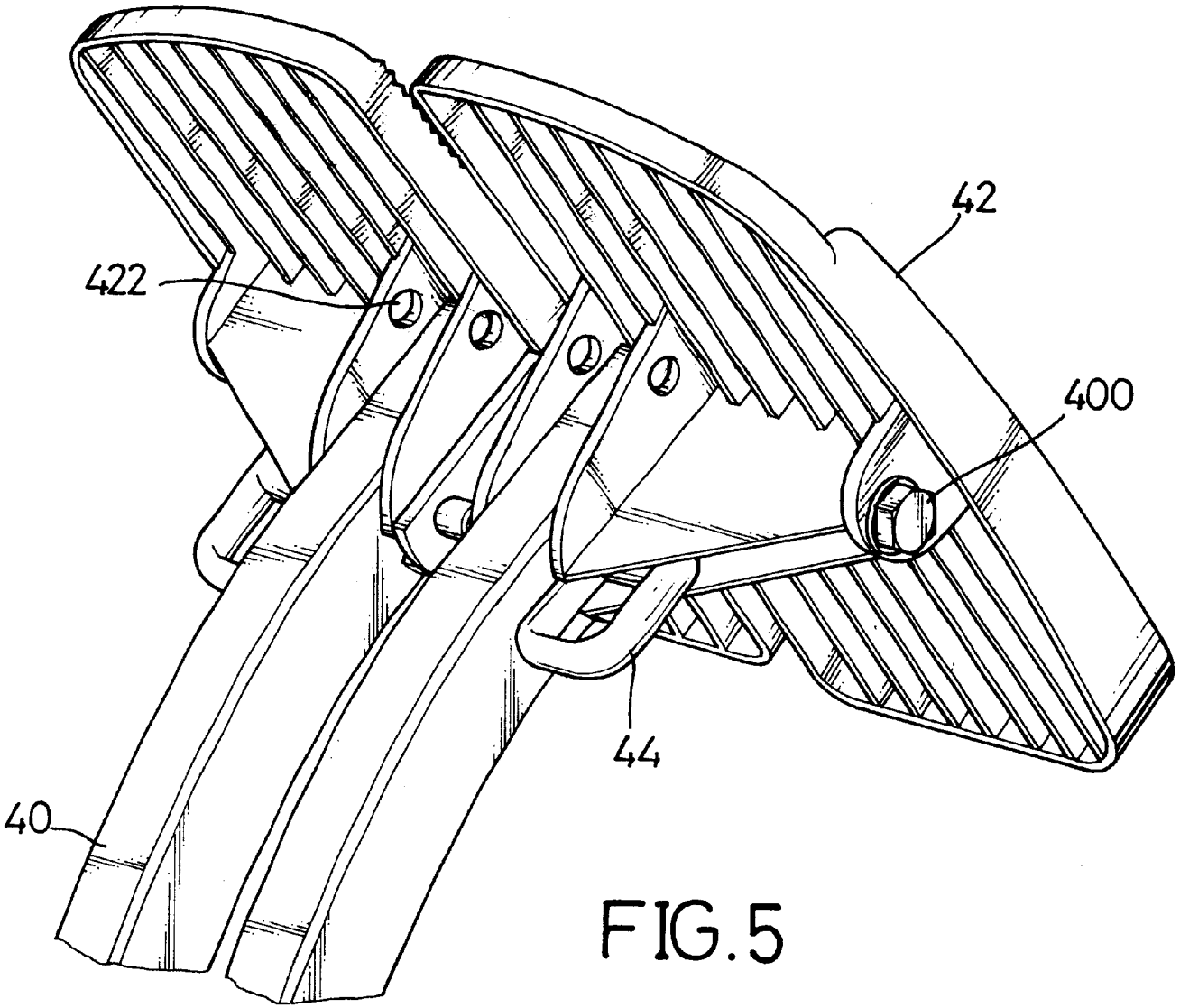
FIG. 5 is a schematic, perspective view showing pedals of the hip exerciser secured on shafts of the exerciser.
Figure 6:
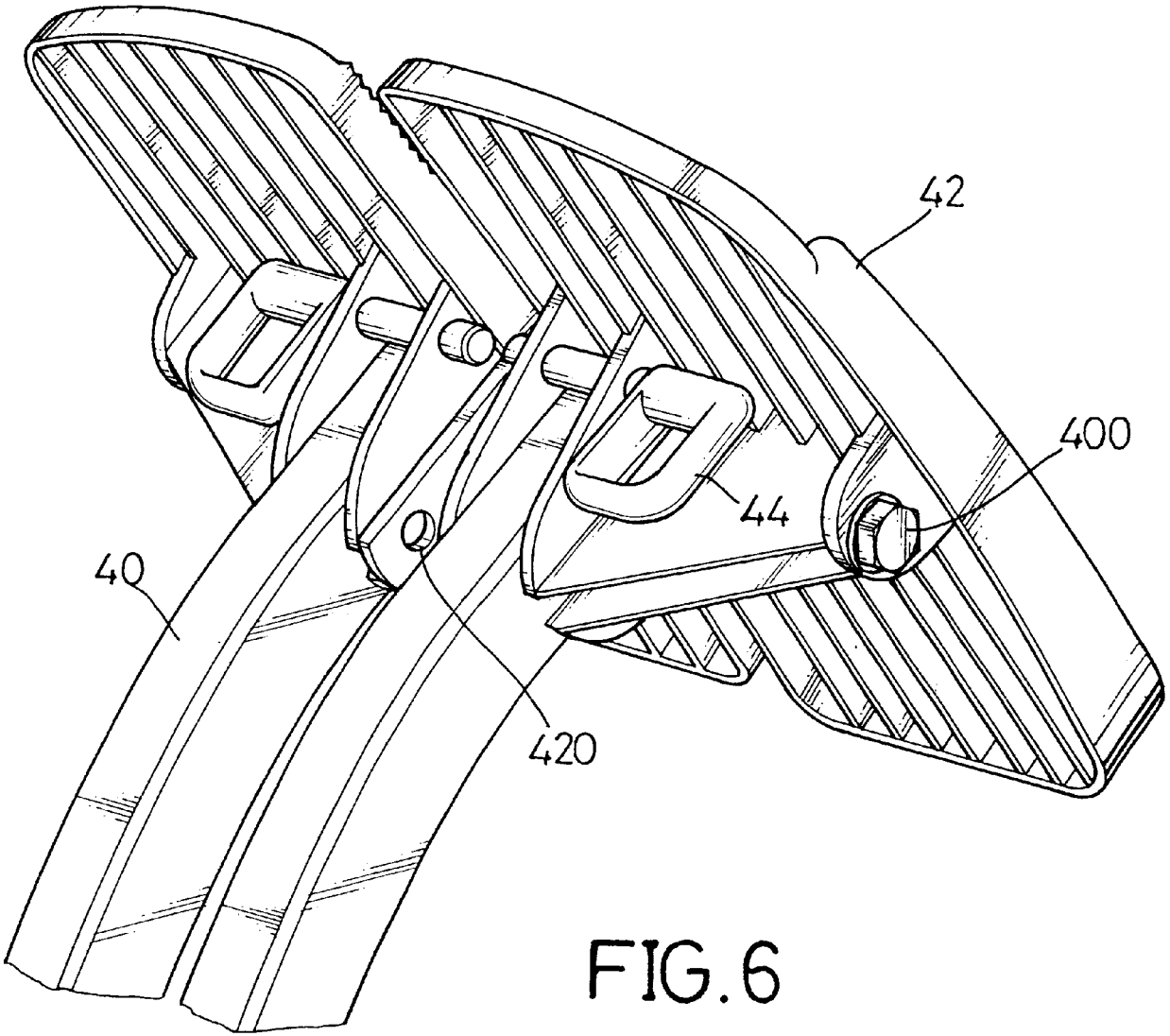
FIG. 6 is a schematic, perspective view showing the pedals released with respect to the shafts.

With reference to FIGS. 5 and 6, two pegs (44) are used to secure the pedals (42). Each of the pedals (42) has a first through hole (420) and two second through holes (422) defined in the under side of the pedal (42). A third through hole (not shown) is defined in a position of each shaft (40) corresponding to the first through hole (420). The peg (44) can be selectively inserted into the first through hole (420) and the second through holes (422) of the pedal (42). If the peg (44) is inserted in the first through hole (420) of the pedal (42) and the third through hole of the shaft (40), the pedal (42) is secured on the shaft (40), that is, the pedal (42) can not pivot with respect to the shaft (40). If the peg (44) is inserted in the second through hole (422) of the pedal (42), the pedal (42) is pivotal relative to the shaft (40) (as shown in FIG. 7).

Figure 7:
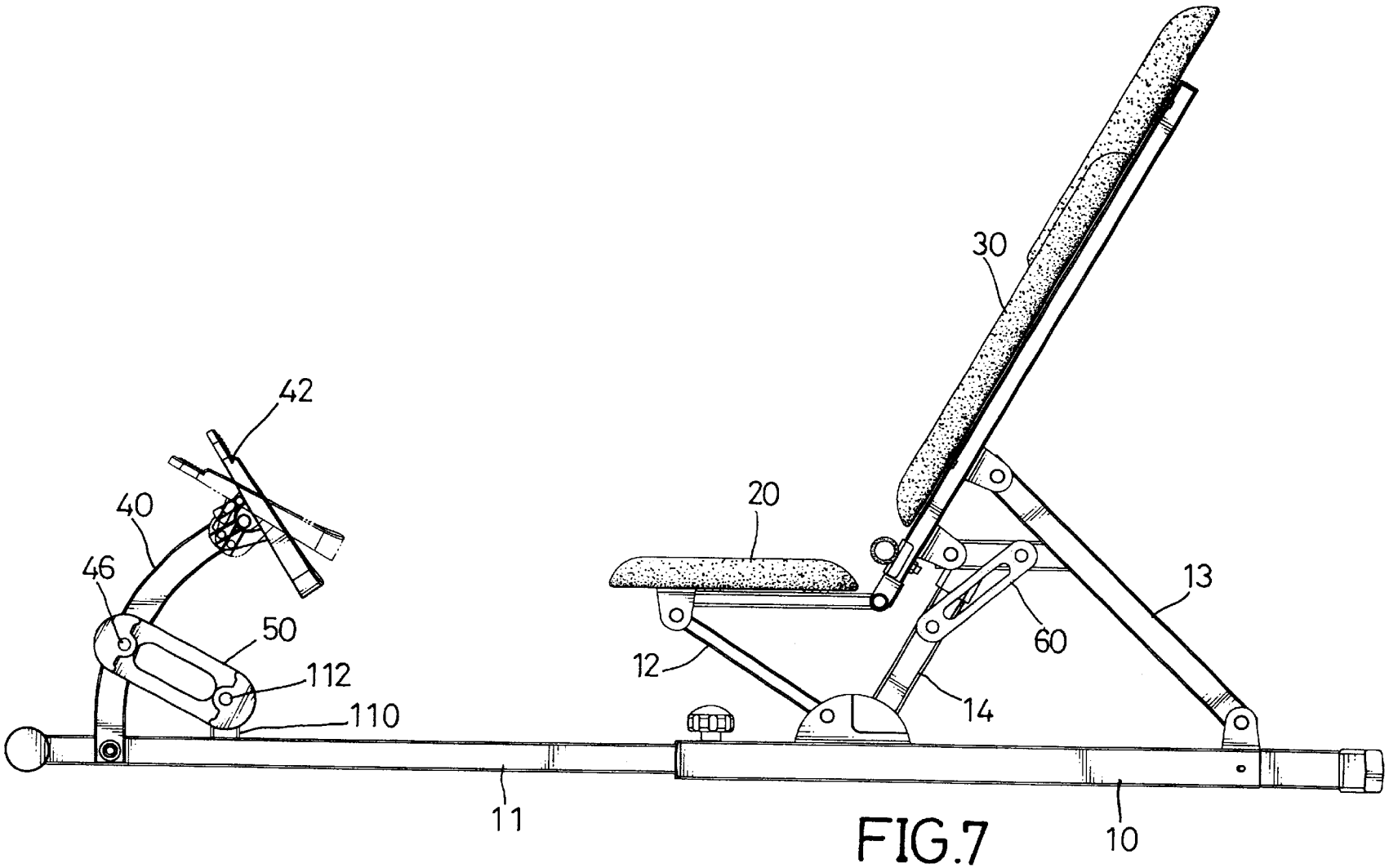
FIG. 7 is a schematic, side view showing the exerciser, wherein a resilient member and a securing member are interchanged.
Figure 8:
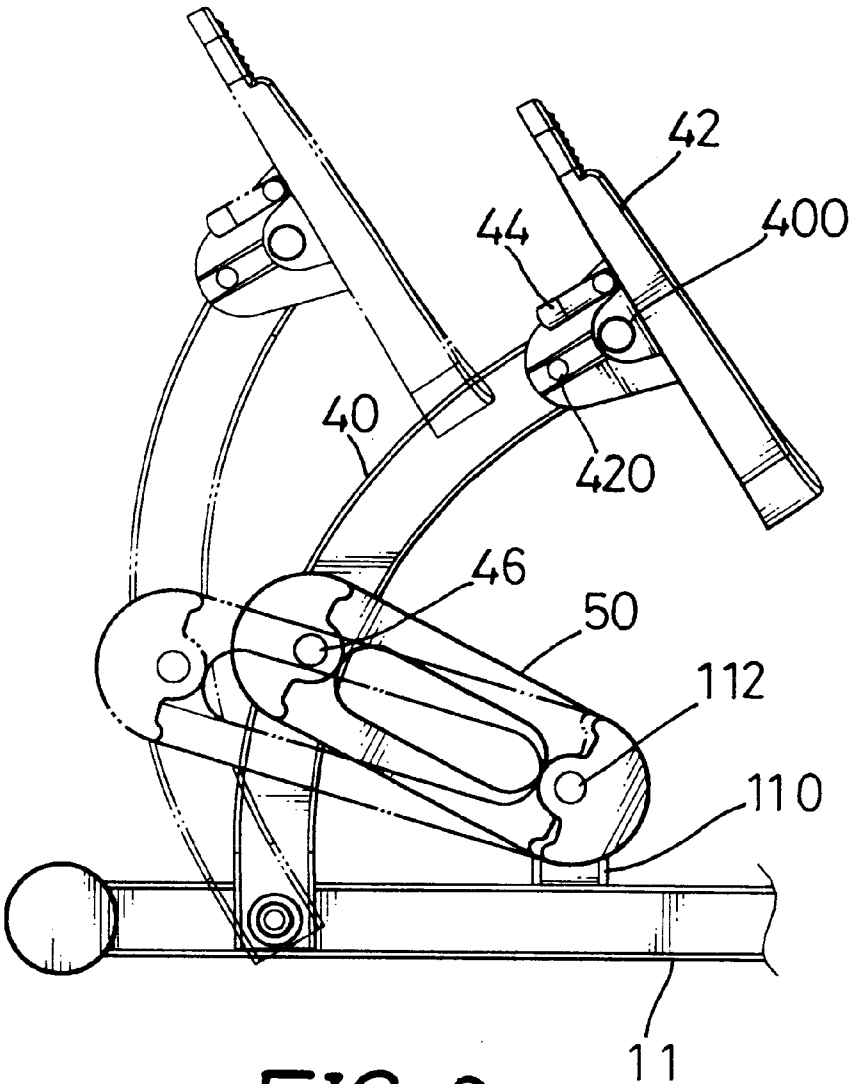
FIG. 8 is an operational, side view of the movement of the shafts.
Figure 9:
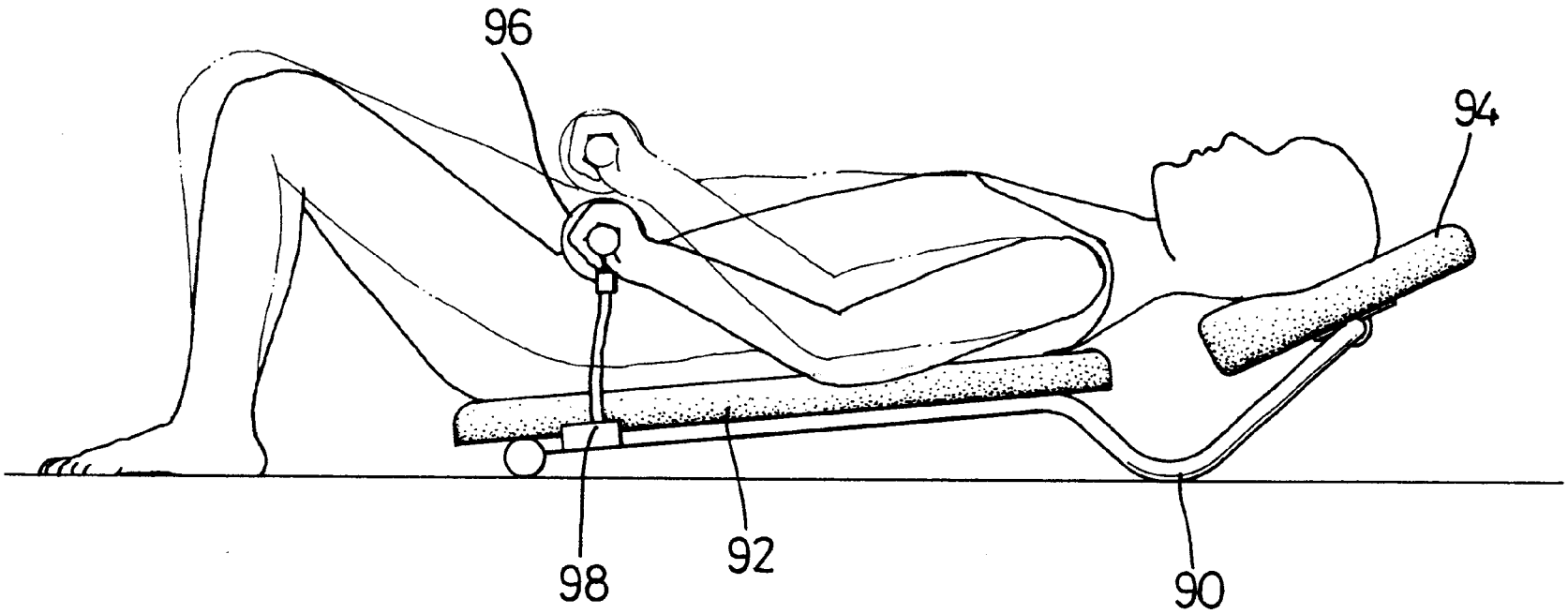
FIG.9 PRIOR ART
FIG. 9 is an operational, side view showing a conventional hip exerciser.

With reference to FIGS. 7 and 8, the exerciser can be operated in another way. The resilient members (50) and the securing members (60) can be interchanged. The resilient member (50) is now mounted between the third rod (112) of the column (110) and the fourth rod (46) of the shaft (40), and the securing member (60) is mounted between the first rod (132) of the rear bracket (13) and the second rod (140) of the front.bracket (14). By this interchanging of the resilient member (50) and the securing member (60), the seat (20), the backrest (30) and the main stand (10) are fixed relatively, while the shafts (40) are pivotal to the extendable stand (11). The user can therefore sit on the seat (20) and step on the shafts (40) to perform a stepping exercise. It is noted that the shafts (40), the pedals (42), and the resilient members (50) are symmetrically distributed thus the shafts (40) each can operate independently, whereby each foot of the user can step independently.

From the above description, it is noted that the invention has the following advantages:

1. The hip exerciser enables the hips of a user to be exercised comfortably and safely.
2. The hip exerciser can be conveniently adjusted to suit users of different sizes.
3. The hip exerciser can be modified into a leg exerciser.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hip exerciser comprising:

a main stand;

a front bracket pivotally connected to the main stand;

a seat support pivotally connected to the front bracket;

a seat security mounted on the seat support;

a rear bracket pivotally connected to the main stand;

a backrest support pivotally connected to the rear bracket and the seat support;

a backrest securely mounted to the backrest support;

a supporting racket securely mounted on the main stand so as to selectively support the rear bracket and to limit the pivotal movement of the front bracket; and at least one resilient member mounted between the front bracket and the rear bracket, wherein a first rod extends from the rear bracket and a second rod extends from the supporting bracket, and the at least one resilient member is mounted between the first rod and the second rod, whereby a user leans to pivot the backrest, and the front bracket and the rear bracket are also pivoted so that the resilient member is extended and provides resistance force.

2. The hip exerciser as claimed in claim 1 further comprising a handle mounted on the backrest support for the user to grasp in order to maintain balance.

3. The hip exerciser as claimed in claim 1 further comprising an extendable, stand moveably extending from the main stand.

4. The hip exerciser as claimed in claim 3, wherein a knob is mounted on the main stand to secure the extendable stand with respect to the main stand.

5. The hip exerciser as claimed in claim 4 further comprising two shafts pivotally connected to opposite sides of the extendable stand close to a free end of the extendable stand, and two pedals each pivotally connected to a free end of the shafts.

6. The hip exerciser as claimed in claim 5 further comprising a column and multiple securing members, wherein the column integrally extends from the extendable stand and the securing members are mounted between the column and the shafts to secure the relative position between the shafts and the column.

7. The hip exerciser as claimed in claim 6, wherein holes are defined in the pedals and the shafts, and multiple pegs are used to extend through the holes to secure the pedals from pivoting with respect to the shafts.

8. The hip exerciser as claimed in claim 1, wherein the rear bracket further has a branch rod extending therefrom, the branch rod is pivotally connected to the backrest support, and the first rod extends from the branch rod.

* * * * *